United States Patent [19]

Koster

[11] Patent Number: 4,934,707

[45] Date of Patent: Jun. 19, 1990

[54] STOCK MARKET BOARD GAME

[75] Inventor: John S. Koster, Beaconsfield, England

[73] Assignee: Timesmart Limited, United Kingdom

[21] Appl. No.: 213,904

[22] Filed: Jun. 30, 1988

[30] Foreign Application Priority Data

Jun. 30, 1987 [GB] United Kingdom ..... 87 15343

[51] Int. Cl.[5] ..... A63F 3/00

[52] U.S. Cl. ..... 273/240; 273/278

[58] Field of Search ..... 273/256, 278, 240, 256, 273/278

[56] References Cited

U.S. PATENT DOCUMENTS 3,237,948 3/1966 Murray ..... 273/256
3,397,896 8/1968 Newton ..... 273/278
3,539,189 11/1970 Shelton ..... 273/256

FOREIGN PATENT DOCUMENTS 2330420 6/1977 France ..... 273/256
1443143 7/1976 United Kingdom ..... 273/256
1587415 4/1981 United Kingdom ..... 273/256

*Primary Examiner*—Benjamin Layno
*Attorney, Agent, or Firm*—Notaro & Michalos

[57] ABSTRACT

A board game consists of a hexagonal playing board 1 (divided into six playing areas, each area designated for one player, and having a central hexagonal area 2. Each playing area is subdivided into a plurality of unit areas 3 radiating from the central area. Each playing area having the same number of unit areas. Each unit area 3 bears a representation of the name or trademark of one of a set of companies and each playing area having the same set of companies. Players use imitation money to buy blocks representing shares which are dealt with in accordance with a plurality of randomly distributed playing cards each equating to a rise or fall in share prices. The blocks bought by the players are placed on the unit areas of the player's corresponding playing areas indicating which companies the players have bought stock in and the number of shares.

3 Claims, 3 Drawing Sheets

FIG. 3.

Stockmarket!

Share Price Chart

| Account Period | Hanson Trust | United Biscuits | Sainsbury's | Barclays | Saatchi & Saatchi | British Petroleum |
|---|---|---|---|---|---|---|
| | £2.00 | £2.50 | £4.00 | £5.50 | £7.50 | £8.00 |
| 1 | | | | | | |
| 2 | | | | | | |
| 3 | | | | | | |
| 4 | | | | | | |
| 5 | | | | | | |
| 6 | | | | | | |
| 7 | | | | | | |
| 8 | | | | | | |
| 9 | | | | | | |
| 10 | | | | | | |

STOCK MARKET BOARD GAME

This invention relates to a board game based on stock trading.

According to the invention there is provided a board game comprising in combination:

(1) A playing surface divided into a plurality of playing areas, each area being subdivided into a plurality of area units, each unit bearing a representation of the name or trademark of a company, (2) a multiplicity of playing blocks each representing a numerical value of shares, (3) a multiplicity of playing cards each bearing a representation of a rise or fall in share prices of a respective said company, and (4) a multiplicity of playing notes or pieces each representing an amount of money.

In use, the players use said playing notes or pieces to purchase share-representing playing blocks which are placed on company-representing area units to indicate shares purchased in that company. Shares are dealt in accordance with information provided by a plurality of randomly distributed said playing cards, and the player holding the greatest value of shares and money at the end of the game is the winner.

SUMMARY OF THE INVENTION

Preferred features of the game are as follows:

(1) The playing surface is hexagonal, the unit areas radiating out from a central area, said company representations being disposed at or near the outer edges of the unit areas.

(2) A plurality of further playing cards are provided for random distribution, each providing an advantage or disadvantage to the player holding that card.

(3) Said money-representing playing pieces are in the form of imitation gold ingots.

(4) In combination with feature (3) there are also provided a plurality of randomly distributable playing cards signifying a rise or fall in the value of gold.

(5) One or more charts are provided for recording the share prices of the respective companies at the end of each round of trading.

BRIEF DESCRIPTION OF THE DRAWINGS

In order that the invention may be readily understood an embodiment thereof will now be described with reference to the accompanying drawings in which:

FIG. 3 shows a specimen share price chart.

DESCRIPTION OF THE PREFERRED EMBODIMENT

Figure 1:
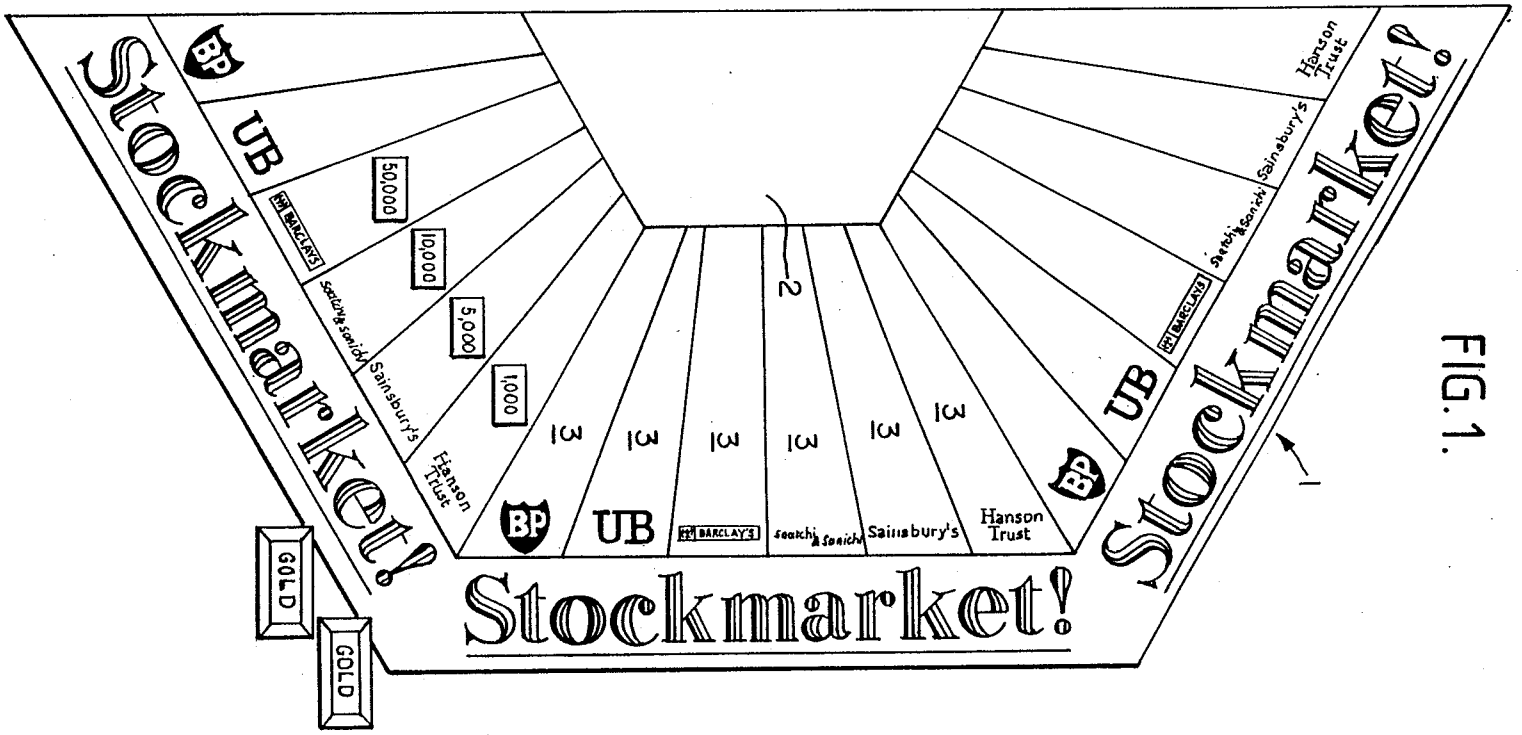
FIG. 1 is a plan view of a part of the playing surface.
Figure 2A:
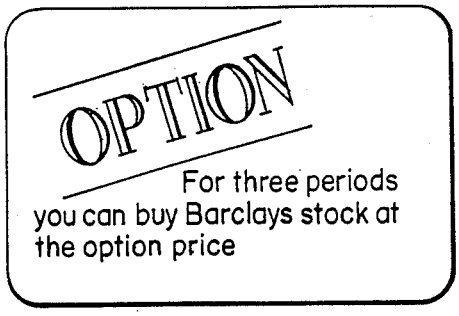
FIGS. 2*a–f* shows a plurality of playing cards.
Figure 2B:
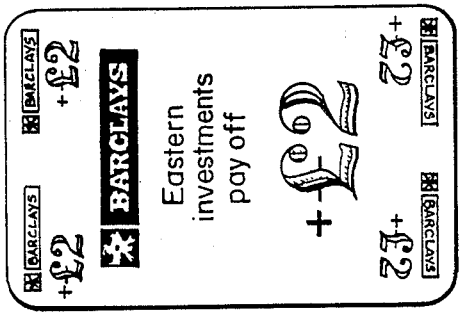
Figure 2C:
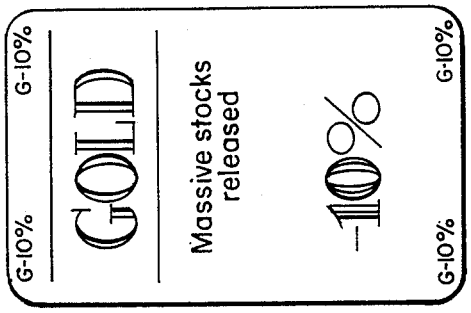
Figure 2D:
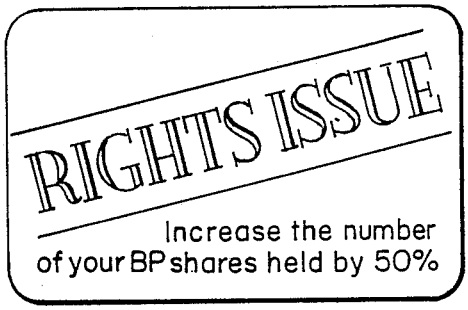
Figure 2E:
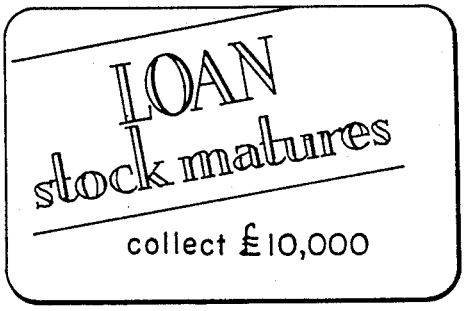
Figure 2F:
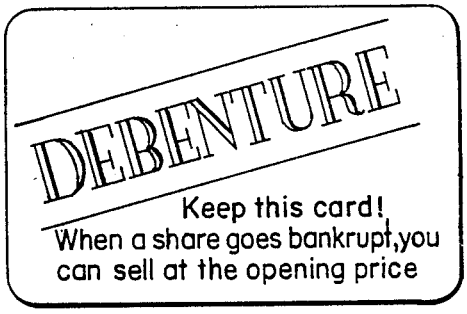

FIG. 1 shows half of a hexagonal playing surface 1 having a central area 2 and a plurality of unit areas 3 radiating thereoutof. Each unit area 3 bears a representation of a well-known company near its outer edge. In use, the positioning of share-representing blocks on one of said unit areas 3 means that the player operating on that combination of unit areas holds the relevant stock in that company.

FIG. 2 shows the randomly distributable cards used for playing the game. 2(*b*) shows a card representing a rise in the shares of one of the companies. Cards representing falling values of shares are also provided. 2(*c*) shows a card representing a rise in the value of gold.

The remaining cards are 'chance' cards which bestow on the player holding them an advantage, as indicated thereon.

FIG. 3 shows a share price chart whereon can be recorded the prices of shares at the end of a playing period, as more fully disclosed in the rules.

The rules for playing the game using the novel playing apparatus are hereinbefore described:

Equipment

Stockmarket contains one playing board with detachable centre piece, 110 share price cards, one pad of share price charts, 10 (black) share blocks of 50,000 shares, 40 (red) share blocks of 10,000 shares, 20 (yellow) share blocks of 5,000 shares, 40 (green) share blocks of 1,000 shares, gold ingots, 10 of £500, 30 of £1,000, 10 of £5,000, 30 of £10,000, 10 of £50,000, 6 of £100,000, 3 of £500,000, 3 chairs.

Object of the Game

The object of the game is to build wealth by speculating on the stockmarket. The winner will be the player who has the most wealth, in terms of the value of all shares and gold owned, at the end of the game.

Preparation for Play

Secure the centre piece on the playing board.

Each player selects a trading segment of the hexagonal trading floor. This should then be retained throughout the game.

Players nominate a 'stockbroker' for the duration of the game. He will issue shares and gold, deal the cards and update share prices at the end of each account period. He may also play in the normal way, but must keep personal funds separate from those of the 'bank'.

The stockbroker distributes £60,000 in gold ingots and a share price chart to each player and shuffles the cards.

Players decide in advance how many bargain periods, ie rounds, there will be from a minimum of 6 to a maximum of 10. With 4 players each bargain period lasts around 10 minutes, hence players can set the approximate duration of the game.

The last player to trade in any one bargain period has an advantage. Hence this is taken in turn clockwise round the board. Initials should be entered on share price charts accordingly.

Start of Play

The stockbroker deals 10 cards face down to each player. The cards show share price movements for the six companies, movements in the value of gold plus some 'chance' cards (see Schedule of Cards for full description).

Players then buy and sell shares according to the information on their cards.

Players make single 'bargains' in turn clockwise around the board. Each player has 3 bargains per bargain period but may pass at any time. A single bargain is defined as buying or selling of shares from any one company (any value) or exercising a chance card.

To buy shares first check their price on the share price chart. Hand the cost in gold to the stockbroker who will pass over share blocks. These must then be placed on the playing board, ie Barclay's shares would be placed against Barclay in the owners segment of the board.

Black blocks denote 50,000 shares, red blocks 10,000 shares, yellow blocks 5,000, green blocks 1,000. Players may only purchase or sell shares in multiples of 1,000 up to and including 5,000; thereafter in multiples of 10,000 only.

When selling shares the blocks must be returned to the stockbroker.

Continuation of Play

When all players have had the opportunity of three bargains the bargain period is closed. All players then reveal all their cards. The final price movement of each company is taken as the sum of all share price cards relating to that company.

This is agreed by the players. The new price is then written in for the next bargain period on their share price chart by all players. This is repeated for all six companies. In the event of any dispute the stockbrokers price shall be deemed correct.

The final movement in the value of gold is also taken as the sum of all cards relating to gold prices. If the value increases the stockbroker will distribute the increase in ratio to the gold held by each player. For instance, if value is up 10% everyone will receive 10% of their existing holding as a bonus from the stockbroker. If value is down 10%, everyone will forfeit 10% to the stockbroker. These values are rounded to the nearest £1,000.

Some chance cards can be played during a bargain period, some must be played when it is over, some may be retained. All cards are clearly marked. Also see Schedule of Cards for full description.

The second bargain period is then played exactly as the first except there are now new share prices. You may have made or lost a fortune! All shares must be brought and sold at the price posted for that bargain period.

If a share price drops to zero or below the company is deemed bankrupt and cannot be traded (purchased or sold). All share price movements for a bankrupt company are started at zero. Hence even a small positive movement in subsequent bargain periods would make the company solvent again.

Each company has a maximum of 200,000 shares available. Any player obtaining 100,000 or more shares automatically and immediately becomes Chairman of that company and places a chair on the playing board. This entitles the player to discard one card relating to the company from all those revealed at the end of each bargain period. If the stockholding falls below 100,000 shares the Chairmanship must be immediately relinquished. In the event of 2 players each owning 100,000 shares the first to achieve this level will be Chairman.

Any player obtaining between 50,000 and 100,000 shares immediately becomes a Director of that company and can discard one card relating to the company from *his hand only.* If the company also has a chairman his discard takes precedence. Only one card may be discarded per company per bargain period.

Winning The Game

As the game progresses players will build their profits and losses from share trading. Profits are then used to build even larger share portfolios and even greater profits. The number of bargain periods can be agreed in advance. The winner is the player with the greatest wealth in value of shares and gold at the end of the game. Share prices are taken as those achieved at the end of the last bargain period.

SCHEDULE OF CARDS

| starting share price | HANSON TRUST 2.00 | UB 2.50 | SAINSBURY 4.00 | BARCLAYS 5.50 | SAATCHI 7.50 | BP 8.00 |
|---|---|---|---|---|---|---|
| Price movements | + 1 | + 1.50 | + 1.50 | + 2 | + 2.50 | + 3 |
| | +50p | + 1 | + 1 | + 1.50 | + 2 | + 2.50 |
| | −50p | +50p | +50p | + 1 | + 1.50 | + 2 |
| | − 1 | −50p | −50p | +50p | + 1 | + 1.50 |
| | | − 1 | − 1 | −50p | +50p | + 1 |
| | | − 1.50 | − 1.50 | − 1 | −50p | + 50p |
| | | | | − 1.50 | − 1 | −50p |
| | | | | − 2 | − 1.50 | − 1 |
| | | | | | − 2 | − 1.50 |
| | | | | | − 2.50 | − 2 |
| | | | | | | − 2.50 |
| | | | | | | − 3 |
| Total | 4 | 6 | 6 | 8 | 10 | 12 |

Total 46.
There are two of each share price card.
Gold Price +10%
−10%
Total 8. Four of each

Chance cards

1. *Share Suspended:* Can be used by the holder at the end of a bargain period to suspend the price of one company only at the level of the previous bargain period. Could be used to avoid a big loss or to stop another player from making a big gain. Cannot be retained. Two cards.

2. *Government Loan Stock* has matured. Play as a bargain (turn). Take 10,000 from the stockbroker. Two cards.

3. *Debenture:* Can be retained and used if a company goes bankrupt to claim, from the stockbroker, the full purchase price of any shares still held. Must be used within two bargain periods of the bankruptcy. Two cards.

4. *Rights Issue:* A 50% rights issue can be claimed on all shares held in one company. ie 1 extra free share for every 2 held. This must apply to all holders of those shares however. The holder can choose the company. 50% of odd numbers are rounded down. Two cards.

5. *Option:* Holder can take an option on the company of his choice to buy or sell at current share price. Play as a bargain (turn). Option must then be exercised (as a turn) and card surrendered within 3 account periods. Two cards.

What is claimed is:

1. A board game based on stockmarket dealings comprising in combination:

(a) a hexagonal playing surface divided into six playing areas each for use by one player, each playing area being subdivided into a plurality of the same unit areas radiating out of a central area with each unit area bearing near its outer edge a representation of one of a set of companies each playing area having the same set of representations, (b) a multiplicity of playing blocks each representing a numerical value of shares which when placed on a said unit area indicates the purchase by a player to whom the relevant playing area is assigned of a corresponding number of shares in that company, (c) a multiplicity of playing cards some of which are randomly dealt to each player, each card bearing a representation of a rise or fall of a share price of a respective company, (d) a multiplicity of playing pieces each representing an amount of money and adapted to be distributed to the players and used by them in the sale and purchase of stocks of the respective companies, (e) a multiplicity of further playing cards some of which are randomly dealt to each player, each further card bearing a representation of an advantage or disadvantage to the player holding the card, (f) at least one chart showing the starting price of shares in the respective companies and having columns in which changes in the respective share prices may be recorded at the end of each round of trading in accordance with predetermined rules of the game, and (g) a set of printed rules prescribing that at the end of a predetermined playing period the players disclose the cards held by them and changes in the share prices of the respective companies are calculated from an aggregate of the cards held by the players.

2. A board game according to claim 1 in which said money representing playing pieces are in the form of imitation gold ingots.

3. A board game according to claim 2 including a plurality of randomly distributable playing cards each signifying a rise or fall in the value of gold.

* * * * *